US006633648B1

(12) United States Patent
Bauck

(10) Patent No.: US 6,633,648 B1
(45) Date of Patent: Oct. 14, 2003

(54) LOUDSPEAKER ARRAY FOR ENLARGED SWEET SPOT

(76) Inventor: Jerald L. Bauck, 7101 S. Heather Dr., Tempe, AZ (US) 85283

( * ) Notice: Subject to any disclaimer, the term of this patent is extended or adjusted under 35 U.S.C. 154(b) by 0 days.

(21) Appl. No.: 09/438,996

(22) Filed: Nov. 12, 1999

(51) Int. Cl.[7] ..... H04R 5/02
(52) U.S. Cl. ..... 381/303; 381/99
(58) Field of Search ..... 381/300, 335, 381/182, 304, 308, 99, 100, 303; 181/144

(56) References Cited

U.S. PATENT DOCUMENTS 4,037,051 A * 7/1977 Fuselier ..... 381/117
4,058,675 A * 11/1977 Kobayashi et al. ..... 381/304
4,199,658 A * 4/1980 Iwahara ..... 381/303
4,410,063 A * 10/1983 Yasue et al. ..... 181/147
4,638,505 A * 1/1987 Polk et al. ..... 381/300
4,819,269 A * 4/1989 Klayman ..... 381/302
5,642,429 A * 6/1997 Janssen ..... 381/182
5,751,821 A * 5/1998 Smith ..... 381/300
5,784,468 A * 7/1998 Klayman ..... 381/300

* cited by examiner

*Primary Examiner*—Forester W. Isen
*Assistant Examiner*—Brian Tyrone Pendleton
(74) *Attorney, Agent, or Firm*—Welsh & Katz, Ltd.

(57) ABSTRACT

The invention is a method of creating an enlarged listening sweet spot for multiloudspeaker audio reproduction. The method employs a plurality of audio drivers displaced generally in a horizontal dimension for a vertically oriented head of a listener, the drivers operating over a plurality of different passbands. Higher frequency drivers are located closer to one another and displaced more towards a center line of the listening space than lower frequency drivers, thereby causing a smaller change in acoustic ear signals for listeners seated away from the designed-for listening position, but without causing increased low frequency signal capacity requirements for phantom images generally outside the array. Specially adapted signal processing accounting for the layout of the various drivers and their associated cross-over networks is employed to create desired audio images.

23 Claims, 12 Drawing Sheets

LOUDSPEAKER ARRAY FOR ENLARGED SWEET SPOT

FIELD OF THE INVENTION

This invention relates generally to the fields of audio signal reproduction and audio signal processing, and more particularly to a system for increasing the area over which a satisfactory audio illusion is created and maintained, relative to prior art audio reproduction systems. The method may employ a multi-way loudspeaker pair with drivers operating over diverse frequency ranges arrayed generally in a horizontal dimension (for a normally-oriented head of a listener) and with higher-frequency drivers generally closer together and displaced more towards the center of the listening space than lower-frequency drivers, and specially-adapted signal processing components for audio imaging to create or maintain desirable audio imaging.

BACKGROUND OF THE INVENTION

The history of stereophonic sound ("stereophony" or, more commonly and colloquially, "stereo") includes a number of methods of recording sounds and another number of methods for playing those recorded signals back to a listener or listeners. While it has always been an accepted idea that a listener should be "transported" to another acoustical space, such as the acoustic space occupied by an audience member at a live concert or a more synthetic, more conceptual, space for many modern popular recordings in which there was no actual performance in front of a live audience, the methods used for this "transporting" have largely failed in that goal. A reason for the failure has been that no systematic, rigorous method was usually applied in designing the various systems, designers and recording personnel frequently instead relying primarily upon largely unscientific principles and serendipity to achieve their goals. That billions of commercial recordings have been sold and broadcast is more a statement of the appeal of the content of the recordings than the ability to transport the listener into another space. However, workers such as Schroeder and Atal, and Cooper and Bauck, have devised playback systems which employ signal processing methods which are firmly footed in engineering science and based on the concept that particular signals will be placed in and around the ears of one or more listeners so that it becomes the task of the producer of the program material to provide a version of the "desired" signals.

These latter-day methods, though currently far in the minority of systems and recordings purchased by consumers to date, can be extraordinarily effective in transporting the listener to another, believable, acoustic space, when properly designed. Perhaps an indication of the failure of traditional systems to perform as hoped, and of the success of the latter-day systems, is that the newer systems are often called "3D audio," "3D sound," and the like ("3D" meaning three-dimensional), and the vernacular use of "stereophonic" often refers to the earlier systems. A simple translation of "stereophonic" from its Greek-root components means "of or relating to three-dimensional sound." Thus, with the advent of practical implementations of the latter-day systems, the audio community found it necessary to coin a new phrase, thus "3D audio" and the like.

In keeping with current usage, we will use the current term, 3D audio, to refer to the latter-day systems. These systems typically employ some kind of circuitry or algorithm which compensates for the fact that sound emanating from each of two loudspeakers impinges on both ears of a listener, so that, for example, sound radiating from a left-placed loudspeaker of a pair of loudspeakers travels to the left ear of a listener, but also travels to the right ear of a listener, this latter sound being called crosstalk. The transmission from each loudspeaker to each ear can be anticipated by designing the circuitry or algorithm, from knowledge of so-called head-related transfer functions (HRTFs), so that when the circuit or algorithm, taken together with at least two loudspeakers, all as a unit, can separately and distinctly control the sounds at the ears of one or more listeners. It is also possible to correct for frequency response aberrations caused by the diffraction of the listener's head so that a natural timbre is perceived by the listener.

It is known in the art, especially in the patents of Cooper and Bauck, that improved performance can be achieved by deliberately modifying the filters comprising the crosstalk cancelling circuitry or algorithms or related circuitry or algorithms from their strict specifications from HRTFs. For example, it may be necessary in some cases to modify the filters in such a way as to make them stable or otherwise realizable. Other modifications are known in the art, such as using HRTFs measured from a model mannequin head rather than the listener's own head, the use of minimum phase transfer functions, the use of simplified head models such as smoothed HRTFS, spheres, or two points in free space (for ears), and the use of delays to convert noncausal filters into causal filters. Some deviations from the full HRTF specifications may be quite extreme, for instance, following the HRTF specification up to only some 600 Hz and allowing factors other than the most precise imaging to specify the response above 600 Hz. Any such modification, while deviating from the strict specification of the listener's own HRTFs, may be considered to be advantageous, either for the sake of performance or economies or both. Also, such modifications may result in less than perfect cancellation of crosstalk and/or less than perfect correction of timbre. Nonetheless, we will refer to all such devices as crosstalk cancellers. Crosstalk cancellers are the heart of most 3D audio systems, allowing predetermined control of signals at the ears of the listener or listeners, thus removing many elements of luck from the playback experience. It is therefore an object of the invention that any crosstalk canceller with any of the several described modifications or other modifications may be used either explicitly or implicitly as the imaging component of the invention.

One application of crosstalk cancellation is in playing back recordings made with an acoustical mannequin, a dummy head with microphones placed in its ear canals or thereabouts. Such a recording-playback system results in the most realistic impression of being transported to another space.

Another application of crosstalk cancellers is as part of an imaging circuit or algorithm, a so-called speaker-spreader or layout reformatter such as described by Schroeder and Atal, and Cooper and Bauck. In this application, the listener can receive the impression that, for example, a pair of loudspeakers which is placed on the sides of a television receiver cabinet, much too close for perceiving any readily noticeable amount of stage width, appear to be farther apart, with well-defined sounds apparently emanating from points in space where there are no actual loudspeakers, a "virtual loudspeaker" impression. In this application, it is most common for the input signals to be any kind of ordinary stereo; the input signals may also be provided by a home theater or multichannel television audio decoder, providing five or more channels of audio signals.

Still another application of the principle of crosstalk cancellation is in the creation of interactively-controlled sound sources (and their reflections in an acoustic environment, if desired) such as would exist in computer-based or game-console-based games, when the sounds for those games are presented to the player or players over loudspeakers.

So it is seen that a crosstalk canceller is a basic component of controlling signals at the ears of a listener, usable with either binaurally recorded programs or with any kind of traditional stereo programs, for the general enhancement thereof.

Playback systems which do not effectively use a crosstalk canceller are also sometimes known as 3D. Such systems can create the impression that sound is arriving from points in space where there are no actual loudspeakers, but rather than provide the impression that there are virtual loudspeakers or other spatially discrete or distinct sources, the impression is that of a wall of sound with little or no impression of spatially discrete sources. To the extent that these systems benefit from placing loudspeakers close together (as described below), they may also benefit from the invention. And of course, enhancement of these "nondiscrete" systems is possible by the use of the virtual loudspeaker concept.

It is an aspect of the invention that it may be used or combined with any type of 3D imaging circuit or algorithm, whether "discrete 3D" or "wall-of-sound 3D."

With the general framework established, we may now begin to discuss a specific problem that exists in essentially all prior-art audio systems, whether of the traditional or 3D variety. Essentially all such systems have a listening area in which the sound impression is best. Listeners in that area receive an impression that is better than at any other place in the playback room or listening space. Typically, there are two loudspeakers and the favored area is on a line bisecting a line segment drawn between the two loudspeakers, and more particularly at a specified distance or other geometrical relationship to the loudspeakers. Wherever the favored region is, it is commonly called the "sweet spot," and we will use that terminology here, even through "spot" may tend to imply "point" rather than "region." The sweet spot is restricted in its extent, frequently being so small that only one person can enjoy the best spatial impression at one time, whether for traditional or 3D stereo; the sweet spot size is sometimes so small that even a singe listener may feel constrained as to where he or she should hold his or her head to fully enjoy the sweet spot. Usually the sweet spot is an elongated region, really rather oblate ellipsoidal in shape, allowing listeners to move in an out along the bisecting line, or up and down while remaining mostly in the bisecting plane, but being very unforgiving with respect to listener movement to the left and right, over wide variations in a standard two-loudspeaker setup. This is the most unfortunate direction in which to have a small extent of the sweet spot, since it is most commonly desired that multiple listeners be seated abreast of one another and not lined up nose-to-nape.

With the advent of practical 3D audio systems and the associated ability to precisely control the sounds at the listener's ears, it is common for listeners to perceive that the sweet spot is smaller than they are accustomed to with prior experience listening to ordinary stereo systems. It has been conjectured by Bauck and Cooper (such conjecture borne out informally by the experience of many listeners to such 3D systems), that the sweet spot is not actually smaller, but, since it is much sweeter, listeners tend to feel more deprived upon moving out of the sweet spot. Also, the rate of deprivation with respect to movement away from the optimum position would appear to be greater, perhaps lending even more feeling that the sweet spot is rather small.

Regardless of the nature of the playback system (traditional or 3D), it is always desirable to make the sweet spot larger. It is, therefore, an object of this invention to do so.

One reason that there is a sweet spot is that with reproduction with two or more loudspeakers, the signals at the listener's ears are formed by the interference (summation) of acoustic waves emanating from the loudspeakers. With two loudspeakers, the field can be controlled precisely (assuming the absence of resonant structures) at only two points. Presumably, those points are to be at the listener's ears. Whether the ear signals are a result of a so-called 3D system or any other technique, if the listener moves his or her head so that the ears are no longer at the designated positions, image distortion will appear, caused by unintended ear signals created by unanticipated interference. The primary causes of the changing interference are differing times-of-arrival due to differing loudspeaker-to-listener distances, followed in importance by amplitude variations of the impinging waves due to the same varying distances (aggravated by the listener sitting close to the loudspeakers), and reflections from any uncompensated reflections (improved by the listener sitting close to the loudspeakers).

An important aspect of this diffraction problem is that for a given amount of movement of the listener's head from the designed-for position it is wavelength dependent. Ear signals at higher frequencies are affected relatively more than those at lower frequencies because the given amount of movement is a larger fraction of a wavelength (or larger number of wavelengths) at the higher frequencies.

In prior art systems, the effects of a listener moving out of the sweet spot are well-known, even by casual listeners. For example, a vocalist who initially appears as a centered phantom image midway between two loudspeakers when the listener is on the bisecting line then appears to subsequently shift towards the nearer loudspeaker when the listener moves away from the bisecting line. The effect is so pronounced that the sound image collapse into the nearer loudspeaker is nearly complete when the listener's head is only a few inches closer to the one loudspeaker than the other. This is the well-known precedence effect, sometimes called the Haas effect after one of its early researchers. It is usually thought to be a psychoacoustic effect, perhaps with its origins in the processing of the inner ear or brain. If that is the case, it may be an evolutionary adaptation to allow accurate localization of sounds in reflective environments. However, it is possible that the effect is also rooted in physical acoustics, a hypothesis that has not been fully investigated. In any event, the amount of image shift as a function of time-of-arrival differences from two sources has been studied thoroughly, with the result that the farther the listener is from the bisecting line, the farther the perceived shift of the center phantom image. It should be noted that the perceived image distortion due to this effect is not, strictly speaking, a shift, but is accompanied by an increase in the spatial extent of the image, or, more oddly, a kind of ambiguity or uncertainty as to the actual location of the image.

One prior art method attempts to reduce the shifting of phantom images by the use of specially designed loudspeakers. Researchers investigating the precedence effect found that the shift of a previously centered phantom image could be partially compensated by increasing the level of the later-arriving sound, that is, by increasing the signal gain of the more distant loudspeaker of the pair. In fact, experimentally derived plots have been published which show how much the gain has to be increased, as a function of time-of-arrival differences, to bring the image back to the center, or approximately so. Such compensations, though not precise and not resulting in a well-formed re-centered phantom, have been found useful enough by a few loudspeaker manufacturers that they have made loudspeakers which had radiation patterns so that as a listener moves from the bisecting line, he or she moves more directly into the main lobe of the more distant loudspeaker. A version of this plan has the listener orienting his or her conventionally-designed loudspeakers so that their main radiation lobes cross in front of the specified listening position (over tow-in). Some found either technique to be helpful, but the compensation is only approximate, and less effective at low frequencies due to the relative impossibility of creating directional radiation patterns at those frequencies. Nonetheless, it is an object of this invention that this type of radiation control may be combined with the novel techniques described herein to accommodate more types of solutions to the sweet spot problem.

Another prior art technique, introduced by Cooper and Bauck, used a method (which is in dependent of the present invention) of alleviating the perceived sweet spot problem in 3D systems by modifying the responses of the acoustically-specified imaging filters at the higher frequencies, effectively allowing gradual transition to "default" imaging of the affected frequencies at the loudspeakers. Listeners seem to prefer having the higher frequencies remain mostly stationary with head movements than to have them flitting around or be otherwise poorly imaged. Indeed, the sweet spot can in fact be enlarged by modifying the filters down to lower frequencies, but at the expense of more and more of the higher frequencies falling into the loudspeakers, a trade-off in sweet spot size for "sweetness." It is an object of the invention that it may be combined with such prior art methods.

A crucial observation is that the time-of-arrival differences from two loudspeakers to either ear of a listener, as he or she moves about on either side of the bisecting line, is diminished if the loudspeakers are close together. A simple plot of time-of-arrival differences is shown in FIG. 1, for a single point in space. The hyperbolic curves represent contours of equal time-of-arrival differences, in milliseconds. The horizontal and vertical axes are positions of the point in space, in meters. The small, heavy circles represent the locations of the two loudspeakers, modeled as point sources. A is calculated for loudspeakers at a distance of 1.5 meters, while B is calculated for a loudspeaker distance of 0.5 meters. (For convenience, the loudspeaker spacing and the line between loudspeakers will be referred to as the baseline distance, or simply the baseline.) It is apparent from these contour plots that the short-baseline array results in smaller time-of-arrival anomalies for the same amount of displacement from the center line. While this simple model and analysis does not include the effects of the listener's HRTFs or indeed the fact that a normally-endowed listener has two ears, it nevertheless illustrates the basic principle. An analysis using a more realistic model will be explored in detail shortly.

That fact that short-baseline arrays hold some advantages was noticed some years ago by Cooper and Bauck. Other researchers have more recently studied the advantages of this approach. The ultimate short-baseline array is the monopole-dipole ("middle-side") array of Lauridsen, and its improvements as taught by Cooper and Bauck. Of course, with the technology of virtual loudspeakers, one may consider deliberately creating a short-baseline array, then expanding the apparent stage width with the appropriate signal processing, for an expanded sweet spot, but at a cost of trading stability of outlying images for improved stability of near-center images, depending upon the details of a particular design. In other cases, a short-baseline array may be dictated by other needs, such as the need to attach loudspeakers on the sides of a television or computer video monitor, or the practical difficulty of locating the several loudspeakers common in current home theaters in their optimum locations.

It is nearly universal practice in loudspeaker design to configure the tweeters and woofers of a two-way loudspeaker, or more generally the various transducing drive units (acoustical emitters) covering different frequency bands in a multiway loudspeaker, in a primarily vertical direction. While there are exceptions, in which for example a midrange driver may be located beside a tweeter, perhaps with one or both of them comprising a "line source" or ribbon-style driver, such side-by-side placement is usually accepted as a compromise in the pursuit of other design goals, and it is usually desired that those drivers should be as close together as possible, horizontally, to maintain signal integrity at the listeners' ears.

There have been attempts to create loudspeaker arrays using horizontally-oriented multi-passband drive units. Electromagnetic versions of such arrays are also used from time to time in communications and radar antennas. In either application, the intent is to control, at least partly, the radiation pattern at various frequencies, usually with the intent that it maintain a constant shape, or beamwidth, at all frequencies of the intended range of operation. Such a goal can be attained, at least partially, by creating an array which is effectively the same length at all frequencies, as measured in number of wavelengths at each frequency. The normal procedure for doing this is to progressively low pass filter the feed signals to the elements of the array more severely for elements lying more towards the ends of the array. This technique remains largely an obscure curiosity in the field of audio reproduction due to the enormous range of frequencies normally encountered (some ten octaves for high fidelity reproduction) and the fact that to attain significant control of the radiation pattern over important portions of the audible spectrum would require arrays of such a large size as to render them impractical. Some proposals have been more modest, suggesting that beamwidth control over as little as an octave can be effective for applications such as sound reinforcement, but this is not an application in which more than one loudspeaker is used to form effective audio phantom images (the field addressed by the invention) nor does the invention teach the formation of constant radiation patterns over frequency variation, although there may well be a tendency towards such behavior as a side effect.

Another prior art loudspeaker employing a horizontal array is that of Polk. However, the drive units of this device are arrayed in this manner for other purposes, do not employ imaging circuitry, do not enlarge the sweet spot, and in other ways do not anticipate the invention.

While the use of a short baseline alleviates the sweet spot problem, another problem arises; the degree of the problem depends on the location and frequency content of a virtual image in a 3D system. Consider that if a natural image containing large amounts of low frequencies relative to other frequencies appears towards a listener's left-hand side (90° counterclockwise from above from the nose which is considered to be at 0°), the dominant air particle motion in the vicinity of the head is to and fro, parallel to a line through the ears. In order for two front-placed loudspeakers to recreate such a low-frequency motion, they must operate with substantially opposite polarity on similar signals. This constitutes, at the lower frequencies, an approximation to the well-known and much-studied acoustic dipole. The problem with this arrangement is that the two loudspeakers tend to cancel one another's low frequency sound (i.e., relatively little low frequency energy is radiated towards the listener). Consequently, potentially large signals must be applied to the loudspeakers, requiring large amplification factors and large excursions of the loudspeaker radiating surfaces, a practical problem in applications of such 3D systems as virtual home theaters and video games reproducing side-placed low frequency sound effects, as well as in 3D processing and playback of many recordings of ordinary music. Another disadvantage is that large amounts of acoustic energy are reflected around the room before finally arriving at the listener, introducing still more unaccounted-for factors into this playback method A closely related scenario is that of a binaural recording being played over a crosstalk canceller. In this application, the low-frequency problem at first appears to be even worse, since the filter specification is for even more bass signal for a virtual source towards the listener's left, as taught most clearly by Cooper and Bauck in their explanation of sum-and-difference style of signal processing. Depending on the loudspeaker angle (as seen by the listener), the bass response of the left-minus-right (L−R) component, that which is predominant in the placement of the left-oriented image, at first inspection seems to be such as to make the whole enterprise nearly impractical, showing a first-order increasing slope (20 dB per decade of frequency) with decreasing frequency, and with the onset of the slope occurring at a higher frequency with more closely-spaced loudspeakers. However, it is important to realize that a naturally-occurring image at 90° necessarily contains relatively little L−R information in the low frequencies, since the ear signals are nearly identical in both amplitude and phase. Therefore, although a large L−R gain might be specified, the L−R signal is small, so the filtered signal might still be of a reasonable size, assuming that the loudspeakers are not too close together. The only practical problem is maintaining a good signal to noise ratio, but this is generally not a problem with either analog or digital implementations. The net result is that the extent of the problem is essentially the same as creating a virtual source as described in the preceding paragraph.

More severe scenarios are easily imagined. It is quite easy to conceive or create a stereo signal which does not correspond to any natural sound image and which will wreak havoc when played through, for example a loudspeaker-spreader or other layout reformatter or crosstalk canceller, all examples of 3D audio systems. For example, a bass guitar in one originating channel of a conventional stereo formatted signal, with silence in the other channel, when played over a crosstalk canceller, is highly unnatural; the playback system attempts to place the sound of a bass guitar in one ear of the listener and silence in the other ear, an extremely demanding task at any reasonable playback volume.

In any of the examples described above, the demands on low-frequency signal excursions in both the amplifiers and loudspeakers increase, that is, get worse, the closer together the loudspeakers are placed. Thus, the desirable effects of a short-baseline array are offset by the greatly increased signal handling capacity required to realized the necessary signals, both electronic and acoustic.

This circumstance, that of increased low-frequency signal capacity requirements with shorter-baseline arrays, is extremely unfortunate, as it compounds with another aspect of low-frequency reproduction of audio signals. As is well known by audio engineers, in an ordinary stereo set, (i.e., one not required to place low-frequency images outside the spatial extent of the usual two-loudspeaker layout or, for that matter, any single-loudspeaker audio reproduction system), the adequate reproduction of the lower frequencies a priori requires that much larger volumes of air be moved. This is normally accomplished by using drivers of larger diameter and with a much larger linear excursion capability than needed for reproduction of higher frequencies. Similarly, most of the linear signal excursion range of the associated amplifiers is used up by the lower frequencies, with the smaller higher frequency components appearing to ride atop the more slowly undulating low frequency components.

The problems of creating adequate signal levels for low-frequency program material placed as virtual images generally outside the extent of a two-loudspeaker array are not merely hypothetical examples. The inventor has observed precisely the behavior that he describes on numerous occasions when demonstrating various types of 3D audio programs. In today's commercial environment, with consumers demanding more realism from their audio systems, with the popularity of home theaters and games and the associated preponderance of high-level, low-frequency, side-placed sound images of special effects (frequently played over actual loudspeakers in a full home theater setup), and the emergence of computers with attached audio systems intended for playing games and simulating home theater systems as "virtual theaters," the scenarios described herein are very real indeed. It would surprise many just how quickly even a rugged, well-designed loudspeaker system can reach its limits under such circumstances, not to mention the inexpensively-made loudspeakers often associated with computers.

Another problem compounds with short-baseline arrays. To overcome the large low-frequency excursion requirements, one might decide to use larger woofers. However, if the woofers are round, it becomes rather nonsensical to find a way to place them close together. One may resort to oval or rectangular radiating surfaces, but these tend to have still other problems. Also, placing large loudspeakers close together may unacceptably compromise the practical and aesthetic design of a product such as a television or computer video monitor.

SUMMARY

Briefly, according to one embodiment of the invention, an audio reproduction system is provided including means for providing any number of audio inputs, means for providing audio imaging using a crosstalk canceller, and a pair of two-way loudspeaker systems, each arrayed with woofer and tweeter substantially horizontally for normally-oriented heads of one or more listeners, such loudspeaker systems comprising frequency-selective crossover circuits to separate and route signals into a left woofer and tweeter pair and a right woofer and tweeter pair, the woofer and tweeter of each pair arranged so that the left and right tweeters are closer together than the left and right woofers, so that time-of-arrival differences from the tweeters vary less with off-center listeners than do time-of-arrival differences from the woofers, for similarly off-center listeners.

BRIEF DESCRIPTION OF THE DRAWINGS

The invention, together with further objects and advantages thereof, may be understood by reference to the following description taken in conjunction with the accompanying drawings.

DETAILED DESCRIPTION OF PREFERRED EMBODIMENT

Figure 1A:
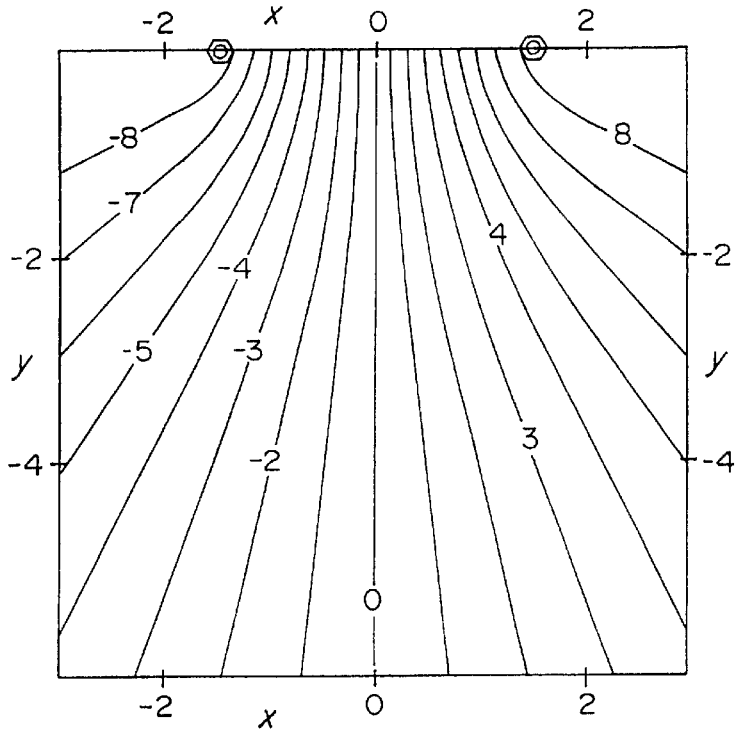
FIG. 1A is a plot of equal time-of-arrival contours for a simple model of a prior art loudspeaker array.
Figure 1B:
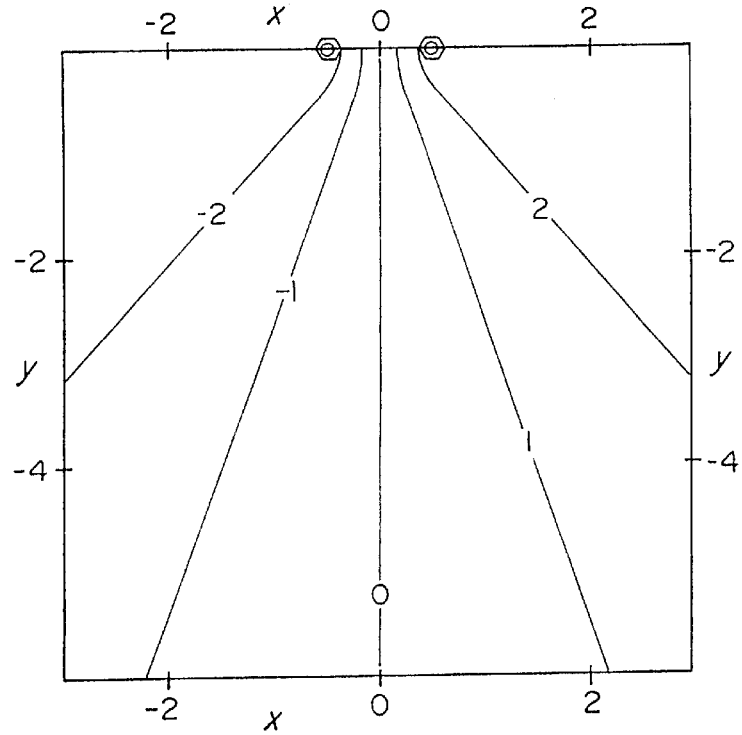
FIG. 1B is a plot of equal time-of-arrival contours for a simple model of another prior art loudspeaker array.
Figure 2:
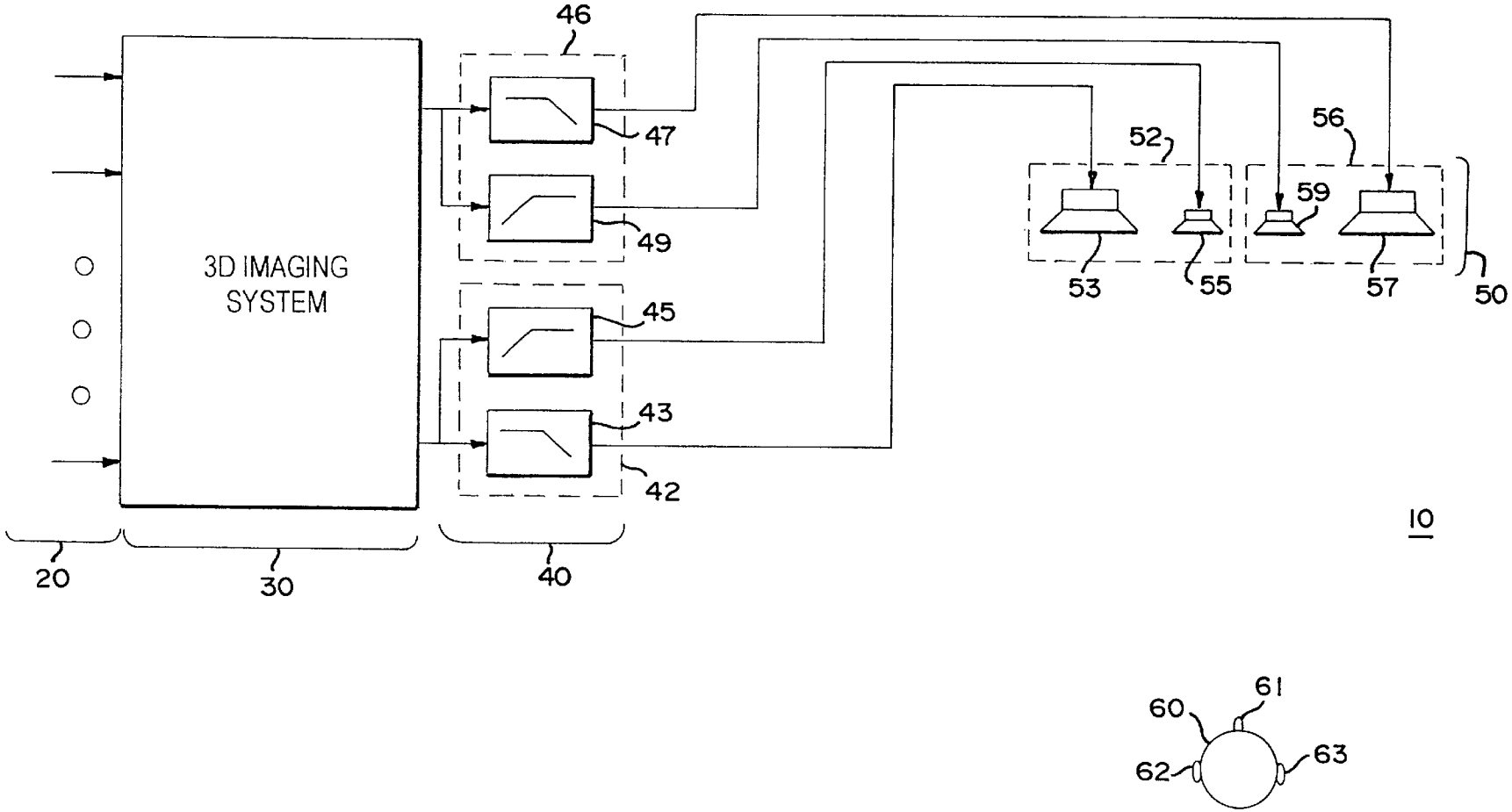
FIG. 2 is a generalized block diagram of a sound reproduction system under an illustrated embodiment of the invention.

FIG. 2 is a generalized block diagram of a specific embodiment of an audio reproduction system 10 according to an illustrated embodiment of the invention. The audio system 10 provides means 20 for coupling one or more audio signals into audio processing circuitry (e.g., computer algorithm) 30. Processed audio signals are then coupled into loudspeaker frequency selective crossover networks 40, including a separate crossover network 42 for the left loudspeaker and a separate crossover network 46 for the right loudspeaker. The left crossover 42 may be comprised of a low pass filter 43 to separate and route low frequency signals to left woofer 53, and a high pass filter 45 to separate and route high frequency signals to left tweeter 55. Similarly, right crossover 46 may be comprised of a low pass filter 47 to separate and route low frequency signals to right woofer 57, and a high pass filter 49 to separate and route high frequency signals to right tweeter 59. The collection of left loudspeaker 52 and right loudspeaker 56 are referred to as the loudspeaker array 50. In this embodiment, two-way left and right loudspeaker systems are described, being the simplest embodiment of the invention, but it will be understood that three-way, or generally, multiway, loudspeakers may be accommodated, and the loudspeaker systems may be arrayed in other ways and in other numbers than the usual symmetric left-right pair, according to the invention. Left loudspeaker 52 is comprised of a left woofer 53 and a left tweeter 55, and the right loudspeaker 56 is comprised of a right woofer 57 and a right tweeter 59. The acoustically radiating elements, woofers 53 and 57 and tweeters 55 and 59, are arranged into a substantially horizontal array, for a normally-oriented listener's head. (If a listener's head 60 is not oriented in a normal, upright, position, then the array 50 may be reoriented so as to maintain the same approximate geometrical relationship to the head of the listener, or the imaging circuitry 30 may be adapted accordingly. However, an extremely precise upright alignment of the listener's head 60 is not normally required.)

It is also anticipated that the left loudspeaker 52 and the right loudspeaker 56, instead of begin comprised of separate woofers and tweeters, may alternately or additionally comprise a so-called Walsh type driver, a roughly megaphone-shaped truncated cone from which the higher frequencies radiate preferentially from the smaller-diameter regions; however, according to the invention, instead of the cones being oriented vertically with the small ends on top and the large ends on the bottom as in normal usage, they are instead oriented with the small end closer to the geometric center line and l the large ends being relatively farther away from the centerline.

According to the invention, the tweeters 55 and 59 are to be substantially closer to the median line connecting the center of the head of the listener 60 and the midpoint of the loudspeaker array baseline than are the woofers 53 and 57. In another embodiment, the positions of the left tweeter 55 and the right tweeter 59 are interchanged, but not their electrical connections, so that, for example, as the listener moves to the right, off of the center line, he or she moves more directly in line with the left-channel tweeter, thereby providing a partial and automatic compensation of time-of-arrival error by amplitude adjustment means, according to the teachings of the precedence effect, and also providing additional image stability by geometrical means. Also according to the invention, the imaging circuitry or algorithm 30 is adapted to account for the spatial layout of the various acoustical radiating elements. These and other aspects of the invention, including an improvement in size of sweet spot without increased low frequency signal handling requirements which characterize prior art loudspeaker arrays, will be made clear by a simulation calculation of a specific embodiment, below.

The operation of the embodiment of FIG. 2 will now be described. Assume as an example that a virtual image or virtual loudspeaker is to be placed at 90°. The tweeters 55, 59 are close together; with their high pass crossovers 45, 49, they receive little low frequency signal energy and thus are not subject to the large-excursion signals that would otherwise be required of loudspeakers at that close spacing operating in the bass region. High frequency characteristics of head-related transfer functions from the tweeter angles are generally such as to provide enough transfer function differences between a particular tweeter and both ears (or both tweeters and one ear) as to provide an acceptable solution to the required equations. Thus, at the higher frequencies where the sweet spot from wider-spaced loudspeakers would be the smallest, the close tweeters provide an enlarged sweet spot.

The woofers, spaced farther apart than the tweeters, receive little high frequency energy due to their low pass crossover filters. Thus, they do not impose the small sweet spot at high frequencies that they would if they received high frequency signals. On the other hand, being spaced farther apart than the tweeters, they do not have the large signal excursion requirements that they would if placed closer, say at the tweeter positions.

The other significant component in the embodiment of FIG. 2, the 3D imaging system 30, is designed to account for the different spacings of the woofers and tweeters, and, just as importantly, to account for their crossover filters. Of course, conceptually, the part of the 3D imaging system that needs to be designed specifically for the loudspeaker array-crossover combination is a crosstalk canceller, whether it appears as a separate component or sequence of software instructions, or whether is combined explicitly or implicitly with other 3D imaging components or software such as HRTF simulations in a complete virtual imaging system.

In nearly all conventional, prior art loudspeaker systems, the crossover networks are designed so that, for example, in a two-way system, the woofer and tweeter operate over substantially different passbands. A typical configuration is to operate a woofer up to around 2.5 KHz, where its operation is limited by a low pass filter at frequencies above 2.5 KHz, and to operate a tweeter at frequencies from 2.5 KHz upward, with its operation limited at frequencies below 2.5 KHz by a high pass filter. While the crossover filters do not have abrupt transition bands (it is physically impossible), there tends to be a small range of frequencies near the crossover frequency which are radiated by both woofer and tweeter, even though the woofer and tweeter operate over substantially different passbands. Some designers will even go to great lengths to restrict that band of commonality by specifying expensive, rapid-cutoff crossover filters. However, there are examples of prior art loudspeakers with two drivers operating over different passbands, but which passbands have considerable overlap. A typical example of this concept has two lower-frequency drivers, possibly of identical designs (diameter, electroacoustic parameters, etc.), but with one of them limited by filters to a rather narrower band of frequencies. For example, one driver, commonly referred to as a woofer, may operate from the lowest frequencies, say 40 Hz, to some 100 Hz, while the other driver, perhaps referred to as a "mid-bass" driver, is allowed to handle frequencies up to 2.5 KHz, where a crossover passes the higher frequencies to a tweeter. Such a design allows for increased signal-handling capacity for the lowest frequencies where it is needed most, but does not impose undesirable directional effects at emitted frequencies from 100 Hz to 2.5 KHz caused by the dual drivers operating over somewhat shorter wavelengths where lobing could occur. So, while there are prior art loudspeakers which have drivers operating over substantially overlapping frequency ranges, they are vertically-arrayed, do not use the overlapping passbands to affect desirable imaging effects, and do not operate with specially-designed imaging circuitry or algorithms. It is an object of the invention that horizontally-arrayed drivers according to the invention may have substantially overlapping passbands and such drivers are to be accompanied by suitably modified imaging circuits, as taught in the following discussion describing a simulation of an embodiment of the invention.

A simulation of a specific illustrated embodiment of FIG. 2 will help to described the invention and to clarify its teachings.

For a source of HRTFs, a spherical head model is used (i.e., the head 60 is assumed to be a rigid sphere 0.18 meters in diameter with "ears" 62 and 63 designated as points on a horizontal great circle displaced ±100° from the "nose" 61 which is defined to be the point at 0°). The sphere is assumed to be in a plane wave field when a single source is present. Positive angles are measured as counterclockwise rotations from the nose 61. This model is used because it is convenient to acquire (compute) HRTFs from any angle and is more than adequate to describe and define the invention and its teachings.

The loudspeaker-listener layout example which is examined here is typical of that experienced by a personal computer user. In assumed free-field conditions, the relevant parameters are:

Distance from center of the head 60 to the plane of the video monitor and loudspeaker array 50 is 0.6 m;

Angular displacement of tweeters of the invention, 55, 59, as measured from the center of the head is ±3°;

Angular displacement of woofers of the invention, 53, 57 as measured from the center of the head is ±20°;

Angular displacement of prior art full-range loudspeakers used for comparison is ±3°.

Angular displacement of other prior art full-range loudspeakers used for comparison is ±20°.

Although an assumption of a plane wave in the vicinity of the head 60 and the statement that the loudspeakers are only about 0.6 meters distant are, strictly speaking, inconsistent (the loudspeakers would have to be at infinite distance to create a plane wave around the head), the simulation error, however, is small and has been found to be inconsequential for purposes of analyzing the invention.

Although the loudspeaker array 50 has variously been described as being in a plane with the video monitor or on a horizontal line, it is to be understood that these geometries are required only as specifics to this simulation or as a particular embodiment, and in general may, for example, be arranged along an arc, or, as necessary, electrical delays may be added to the signal processing or in line with the crossovers so as to make the effective acoustic positions be along an arc, or any other geometric figure, as required. Alternatively, the designer of the crossover, if he or she does not place compensating delays in line with the various drivers, will find that the solution for the appropriate crosstalk canceller will dictate such delays. It is an object of the invention that various geometries can be accommodated, with the imaging circuitry 30 adapted accordingly.

The methodology of the simulation is, for each of three layouts described below, to first compute the imaging filters necessary to place an image at a near-worst case (for low-frequency signal capacity requirements) location of 90° for a centered listener (nominal position). The listener's head may then be moved over a grid of points around the nominal, or designed-for, head position, and an error value may be computed and plotted at each such location when using the filters designed for the nominal position. Also, the frequency response magnitudes of the required imaging filters may be plotted. The three layouts examined, as alluded to in the above geometric description, are:

Full-range prior art loudspeakers at "conventional" video monitor spacing of ±20°;

Full-range prior art loudspeakers at "very close" spacing of ±3°;

Modified short-baseline array according to the invention with woofers 53 and 57 at ±20° and tweeters 55 and 59 at ±3°.

Figure 3A:
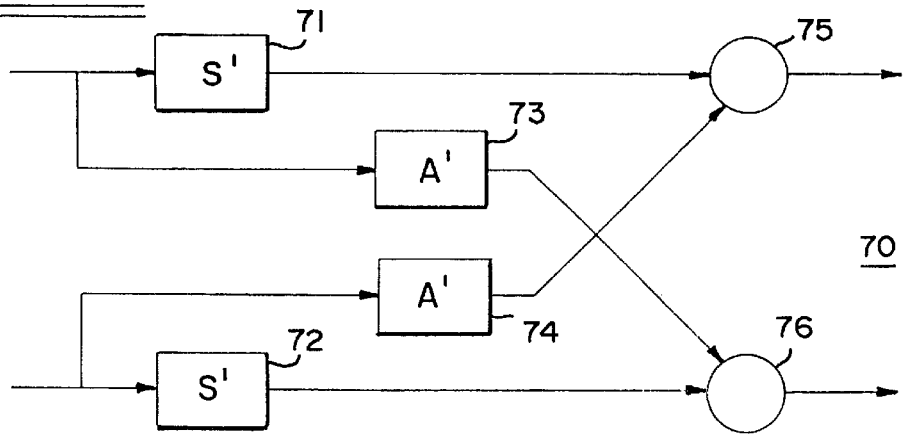
FIG. 3A is a block diagram of an illustrated example of the imaging circuit component of an embodiment of the invention, shown in support of an analysis of the invention.
Figure 3B:
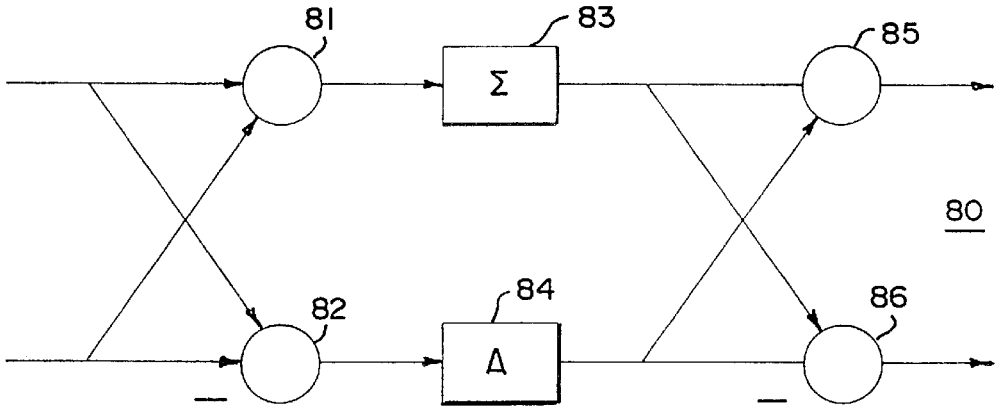
FIG. 3B is a block diagram of another illustrated example of the imaging circuit component of FIG. 2, shown in support of an analysis of the invention.

The various filter magnitude responses are plotted for two types of symmetric topologies for convenience: the lattice in FIG. 3A and the extended shuffler of Cooper and Bauck in FIG. 3B. The phase responses, while as important to proper image formation as the magnitude responses, are not displayed for the present purposes of examining low frequency signal capacity (magnitude) requirements of various layouts, although they are used in the simulation calculations; when a symbol is used to refer to a transfer function, it is assumed to be a complex-valued variable, as is normal for such analyses.

The lattice 70 of FIG. 3A may be used to implement the imaging circuit or algorithm 30 of FIG. 2, as long as there are no more than two inputs 20, as may the shuffler 80 of FIG. 3B, as is known in the art; other topologies are also possible, possibly employing additional lattices or shufflers. The lattice 70 comprises the four filters of two unique transfer functions (assuming geometrical layout symmetry, as in the simulation), S' and A'. The shuffler 80 requires only two filters with transfer functions Σ and Δ. The lattice requires summing junctions 75 and 76. The shuffler requires summing junctions 81, 82, 85, 86, with signal sign inversions at two of the inputs of summing junctions 82 and 86, as indicated in FIG. 3B.

Figure 4:
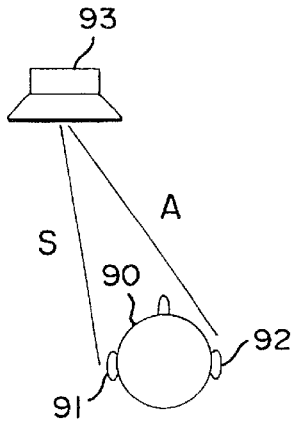
FIG. 4 is a plan view layout diagram showing examples of transfer functions of the system of FIG. 2 from a loudspeaker to a listener.
Figure 5A:
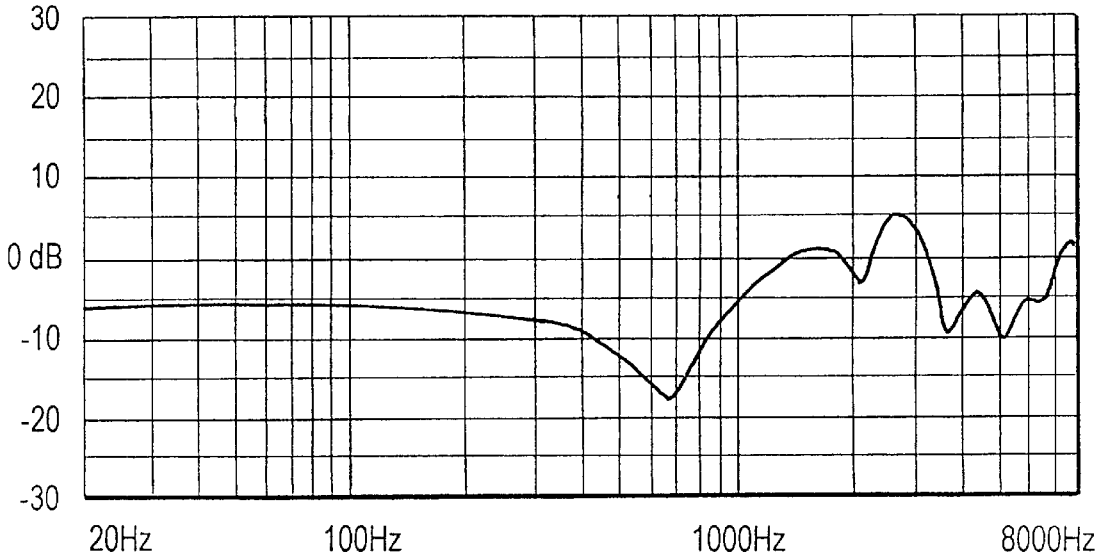
FIG. 5A is a plot of the magnitude of the transfer function of an imaging filter of the imaging component of FIG. 3B, for a prior art loudspeaker array comprising full-range loudspeakers at ±20° relative to a listener.
Figure 5B:
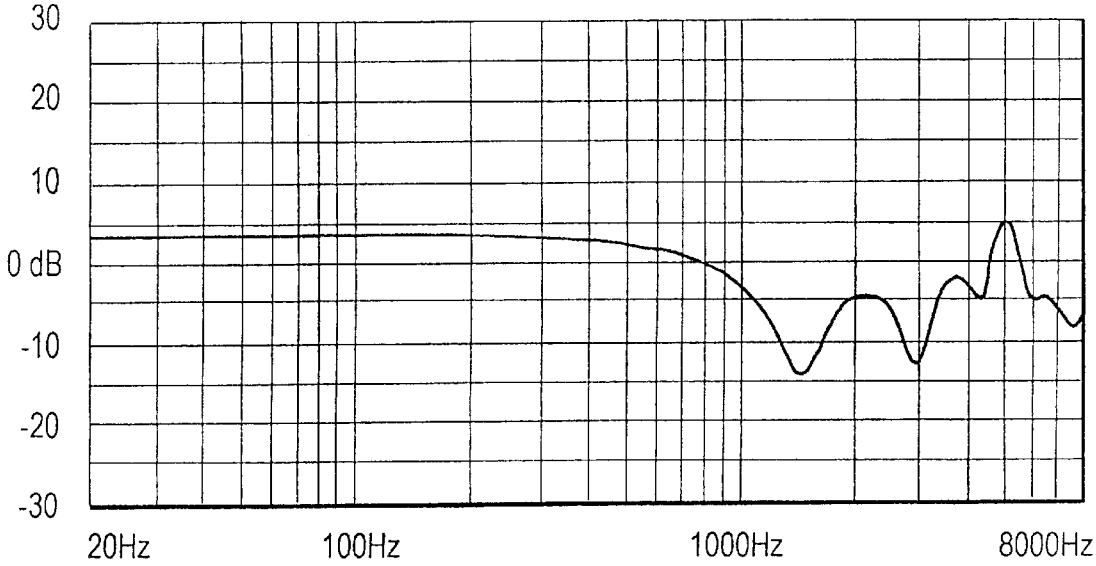
FIG. 5B is a plot of the magnitude of the transfer function of another imaging filter of the imaging component of FIG. 3B, for a prior art loudspeaker array comprising full-range loudspeakers at ±20° relative to a listener.
Figure 5C:
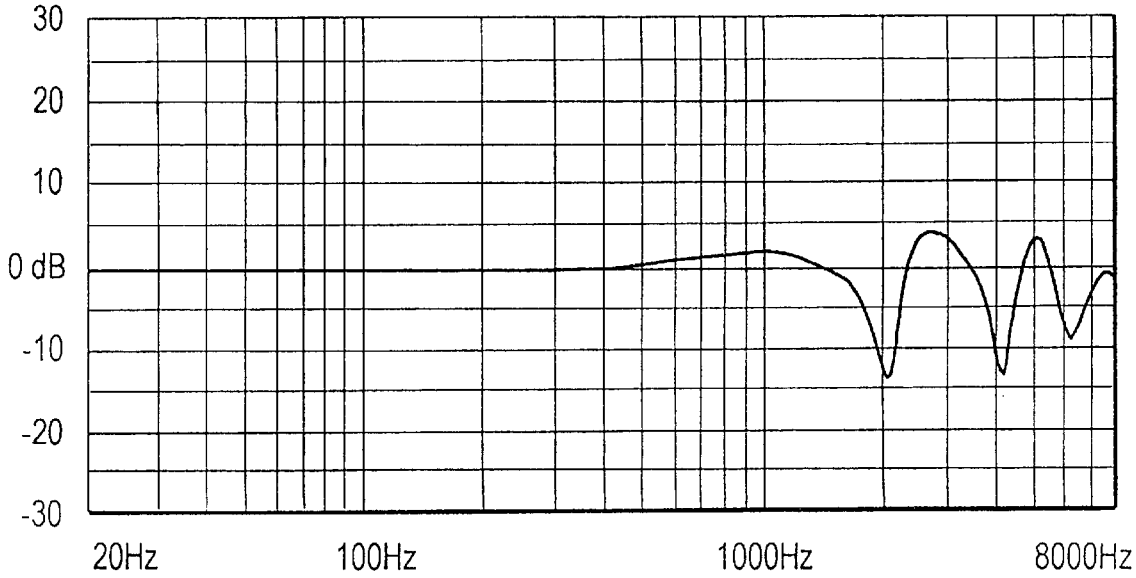
FIG. 5C is a plot of the magnitude of the transfer function of an imaging filter of the imaging component of FIG. 3A, for a prior art loudspeaker array comprising full-range loudspeakers at ±20° relative to a listener.
Figure 5D:
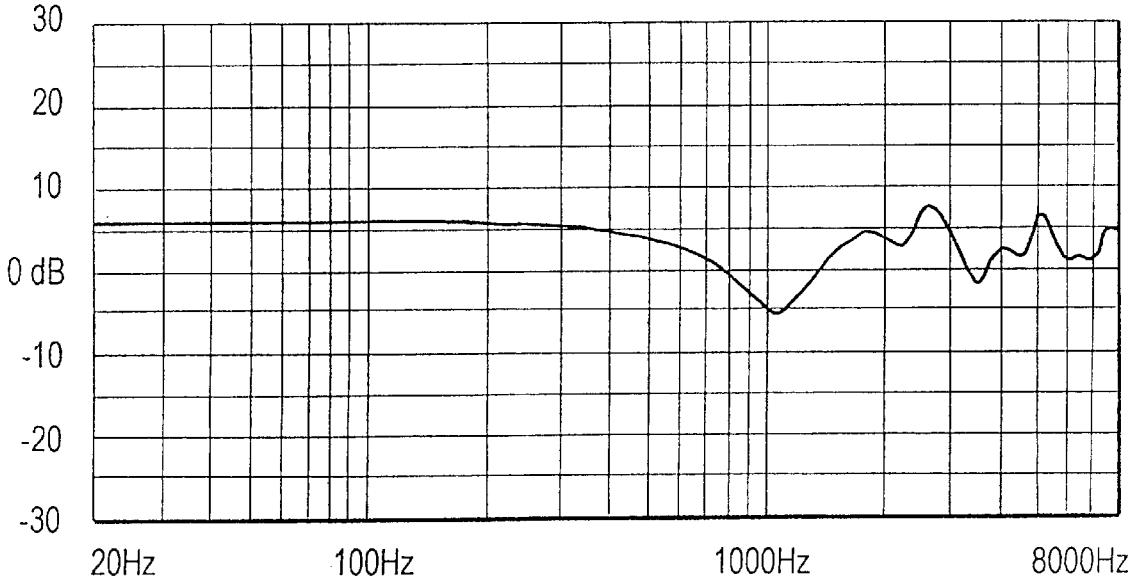
FIG. 5D is a plot of the magnitude of the transfer function of another imaging filter of the imaging component of FIG. 3A, for a prior art loudspeaker array comprising full-range loudspeakers at ±20° relative to a listener.
Figure 6A:
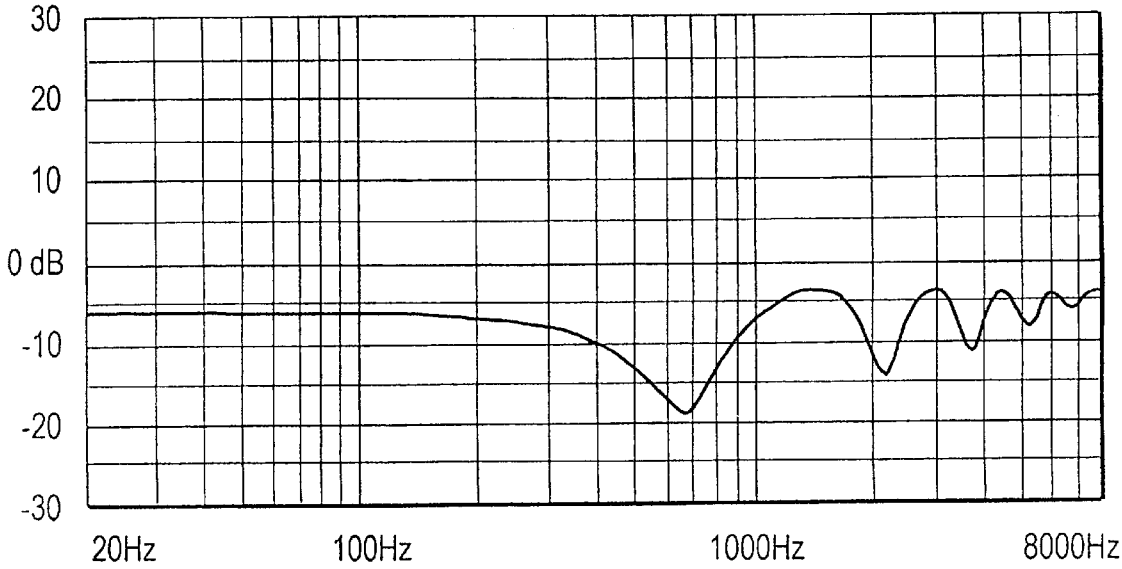
FIG. 6A is a plot of the magnitude of the transfer function of an imaging filter of the imaging component of FIG. 3B, for a prior art loudspeaker array comprising full-range loudspeakers at ±3° relative to a listener.
Figure 6B:
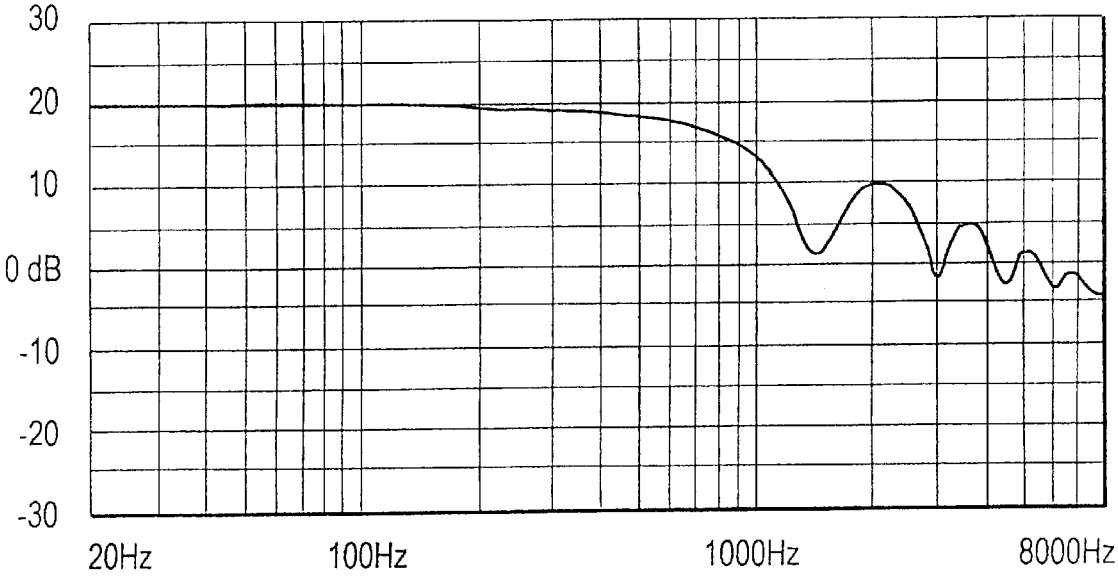
FIG. 6B is a plot of the magnitude of the transfer function of another imaging filter of the imaging component of FIG. 3B, for a prior art loudspeaker array comprising full-range loudspeakers at ±3° relative to a listener.
Figure 6C:
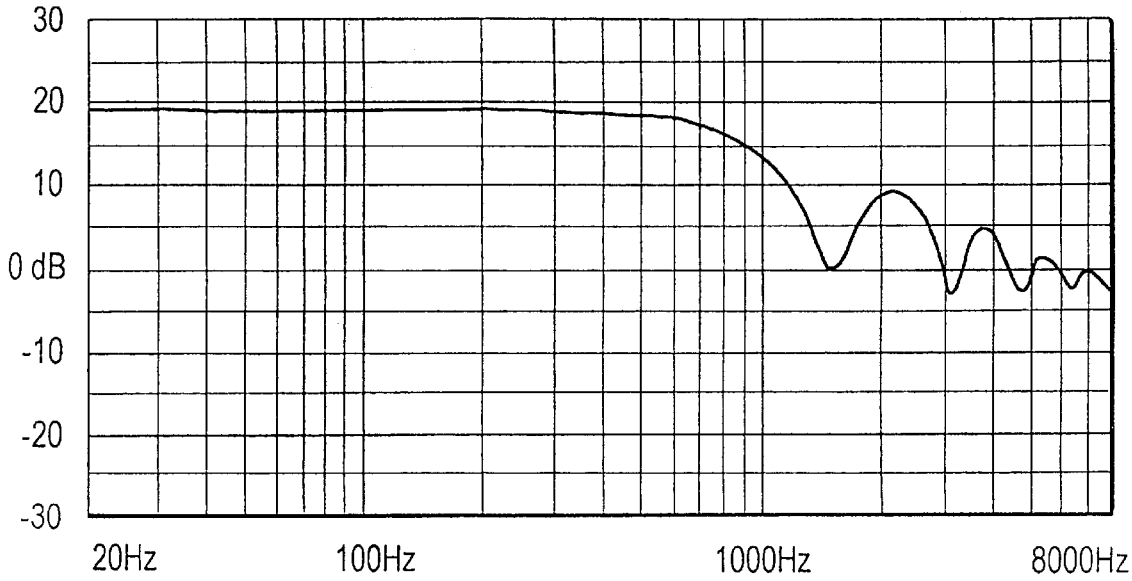
FIG. 6C is a plot of the magnitude of the transfer function of an imaging filter of the imaging component of FIG. 3A, for a prior art loudspeaker array comprising full-range loudspeakers at ±3° relative to a listener.
Figure 6D:
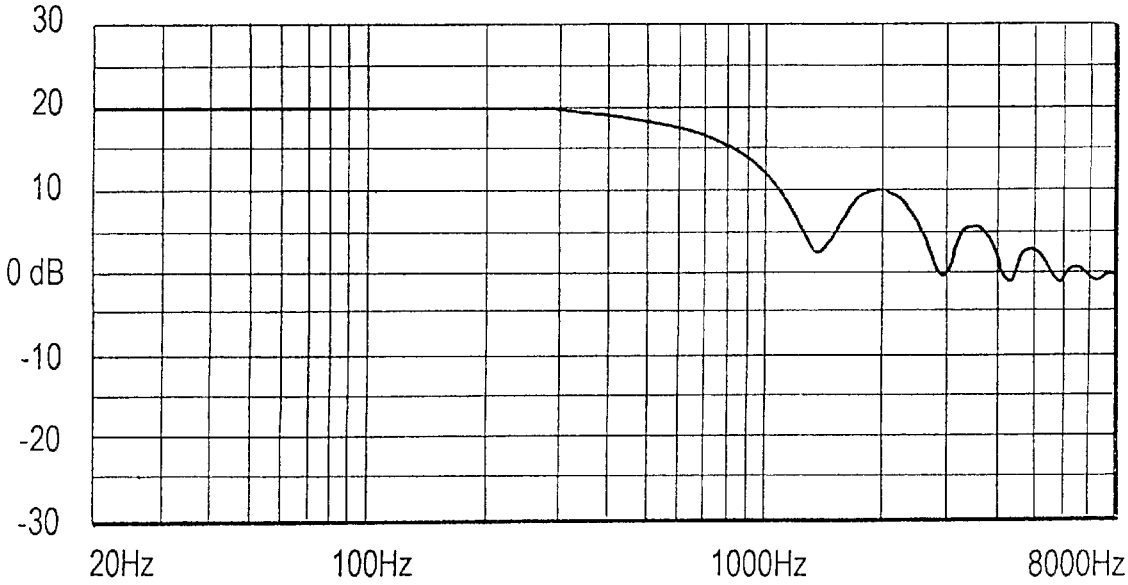
FIG. 6D is a plot of the magnitude of the transfer function of another imaging filter of the imaging component of FIG. 3A, for a prior art loudspeaker array comprising full-range loudspeakers at ±3° relative to a listener.
Figure 7A:
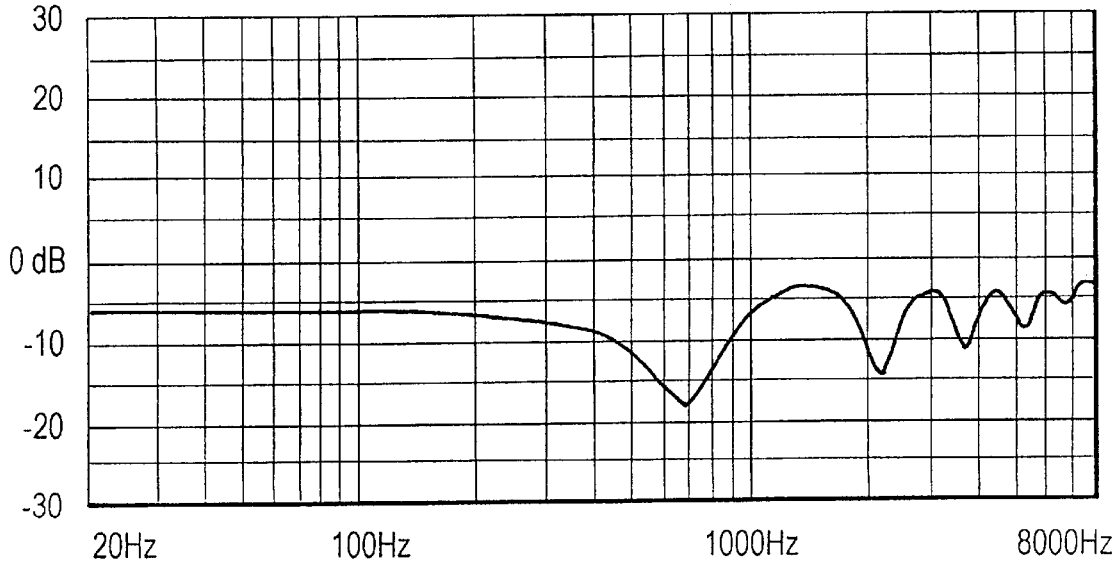
FIG. 7A is a plot of the magnitude of the transfer function of an imaging filter of the imaging component of FIG. 3B, for an embodiment of the invention, a loudspeaker array comprising woofers at ±20° and tweeters at ±3°, both relative to a listener.
Figure 7B:
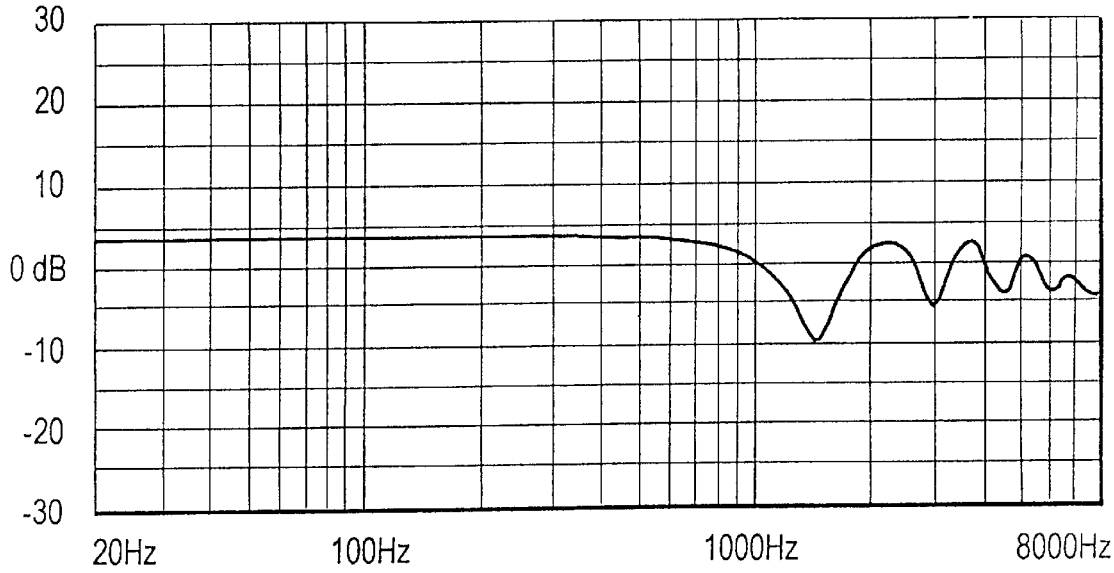
FIG. 7B is a plot of the magnitude of the transfer function of another imaging filter of the imaging component of FIG. 3B, for an embodiment of the invention, a loudspeaker array comprising woofers at ±20° and tweeters at ±3°, both relative to a listener.
Figure 7C:
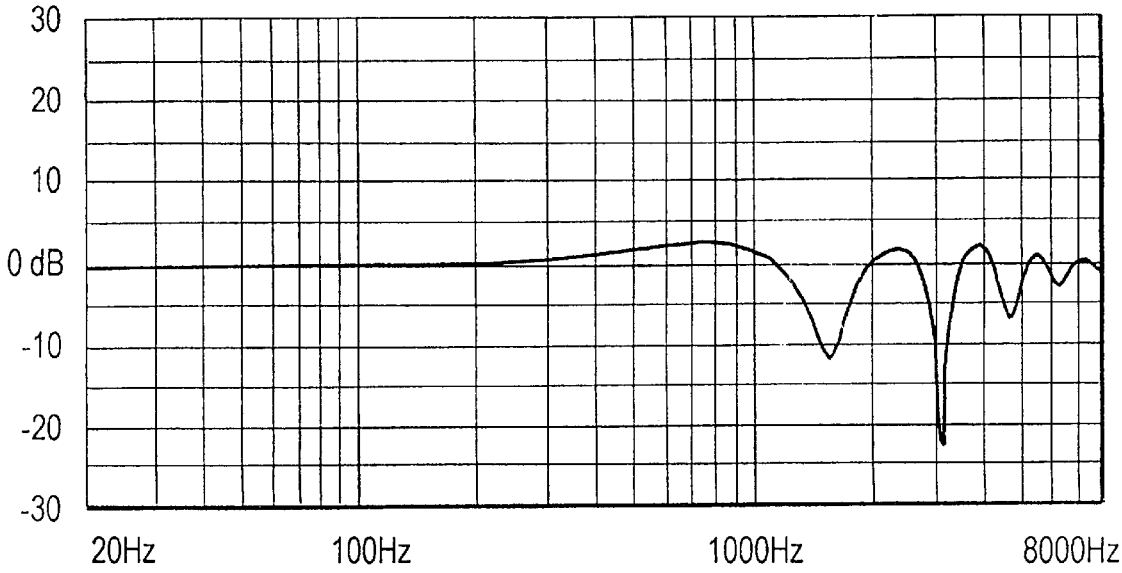
FIG. 7C is a plot of the magnitude of the transfer function of an imaging filter of the imaging component of FIG. 3A, for an embodiment of the invention, a loudspeaker array comprising woofers at ±20° and tweeters at ±3°, both relative to a listener.
Figure 7D:
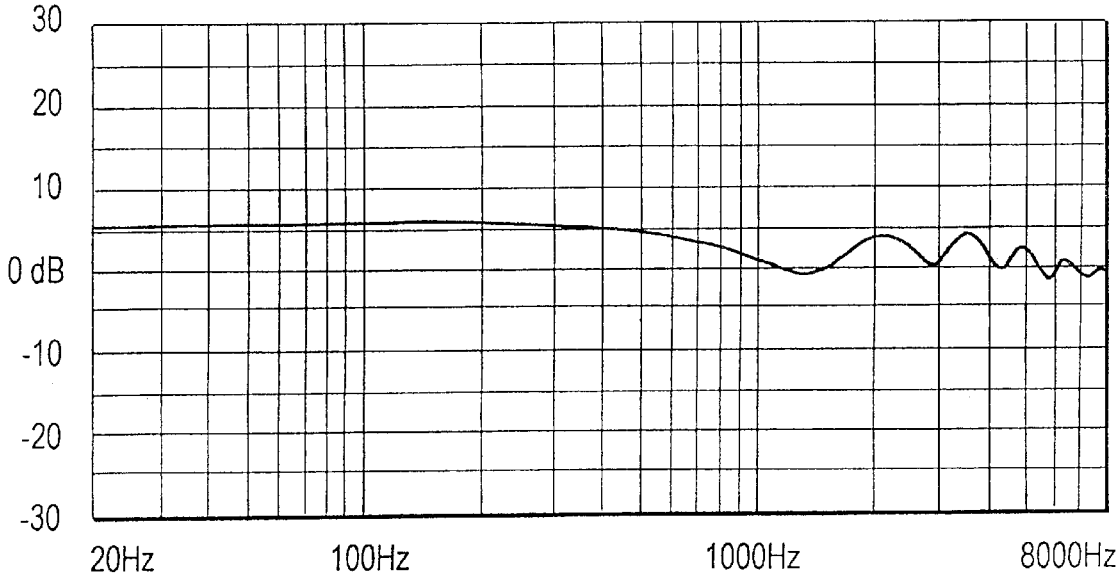
FIG. 7D is a plot of the magnitude of the transfer function of another imaging filter of the imaging component of FIG. 3A, an embodiment of the invention, a loudspeaker array comprising woofers at ±20° and tweeters at ±3°, both relative to a listener.

FIG. 4 serves to establish the naming convention for acoustic transfer functions, generically, S and A. Subscript a indicates a transfer function associated with an "actual" loudspeaker, and subscript ϕ indicates a transfer function of a "phantom," in this case the desired image at 90°. With this notation, the imaging filter transfer functions when using symmetrically-placed full-range loudspeakers are $$\Sigma = \frac{1}{2}\frac{S_\phi + A_\phi}{S_\alpha + A_\alpha}$$

$$\Delta = \frac{1}{2}\frac{S_\phi - A_\phi}{S_\alpha - A_\alpha}$$

$$S^{1\prime} = \Sigma + \Delta$$

$$A^{1\prime} = \Sigma - \Delta$$

In the simulation, the grid over which the spherical-model head is moved for computing an error measure is a square of 0.322 meters per side centered on an x-y coordinate system which has as its origin the center of the nominally-placed spherical head. For 50 frequency points $f_n$, n={1, 2, . . . , 50), evenly spaced between 20 Hz and 8000 Hz, frequency domain signals for the left ear $E_L(f_n, x, y)$ and right ear $E_R(f_n, x, y)$, and nominal-position ear signals $E_L(f_n, 0, 0)$ and $E_R(f_n, 0, 0)$, an error measure $$\varepsilon(x, y) = 20\log_{10}\left(\sum_{n=1}^{50}(|E_L(f_n, x, y)| - |E_L(f_n, 0, 0)|)^2 + (|E_R(f_n, x, y)| - |E_R(f_n, 0, 0)|)^2\right)$$

is computed. The choice of 8000 Hz as the highest frequency to include in the error is a compromise between including most of the significant audio range for localization and allowing too many sphere-model idiosyncracies to contribute. This is obviously a signal-based error function—its precise connection to perceived error is unknown. The x-y grid spacing was ¼ of the shortest wavelength included in the above sum, and there were 31 grid points in each direction, resulting in the square of 0.322 m. (A grid spacing of ½ the shortest wavelength would be enough for adequate spatial sampling, but the finer grid gives a nicer surface plot.)

For full-range prior art loudspeakers at the ±20° positions (and a virtual image at 90°), the Σ, Δ, S', and A' are shown in FIG. 5. Of particular importance are the low-frequency levels of, for instance, the Σ and a filters. The Σ filter, due to the factor of ½ in its definition, levels off at low frequencies at −6 dB, while the Δ response is some 9.3 dB higher, at 3.3 dB, a quite tolerable level difference for most applications.

The responses corresponding to full-range loudspeakers at ±3° is shown in FIG. 6. Again, the Σ response at low frequencies is at −6 dB, but the Δ response has increased drastically to 25.6 dB above the Σ level.

For the modified array 50, the definition of the acoustic transfer functions need to be modified to account for the different locations of the drivers, as well as for the presence of their respective crossover filters. Let the transfer function of each woofer crossover filter 43, 47 be $C_w$ and the transfer function of each tweeter crossover filter 45, 49 be $C_t$. Also, let the generic transfer functions S and A of FIG. 4 be specialized for the woofer and tweeter positions as $S_w$, $A_w$, $S_t$, and $A_t$. With the help of FIG. 2, the new, composite, "actual loudspeaker" acoustic transfer functions can be seen to become $$S_\alpha = C_w S_w = C_t S_t$$

and $$A_\alpha = C_w A_w = C_t A_t$$

These expressions can then be used in the calculation of the imaging filters Σ, Δ, S', and A' in FIG. 3. The crossover filters are simply modeled as first-order low pass responses for $C_w$ 43, 47 and first-order high pass responses for $C_t$ 45, 49, both having magnitude responses which are −3 dB from their asymptotic values at 1 KHz.

For the simulation, no attempt is made to optimize either the layout geometry or the crossover filter response shapes. The main reason for picking 1 KHz for the crossover frequency is that the magnitudes of Δ, S', and A' in FIG. 6 become large at around that frequency. Also, practicalities such as driver characteristics played little role in crossover selection.

The imaging filter responses for the modified array 50 of the invention are shown in FIG. 7. The low frequency parts of these curves indeed resemble the low frequency parts of the curves for ±20° full-range loudspeakers in FIG. 5. Also, the high-frequency parts of the responses of FIG. 7 resemble the high-frequency parts of the responses in FIG. 6 for the very closely spaced full-range loudspeakers at ±3°.

Figure 8:
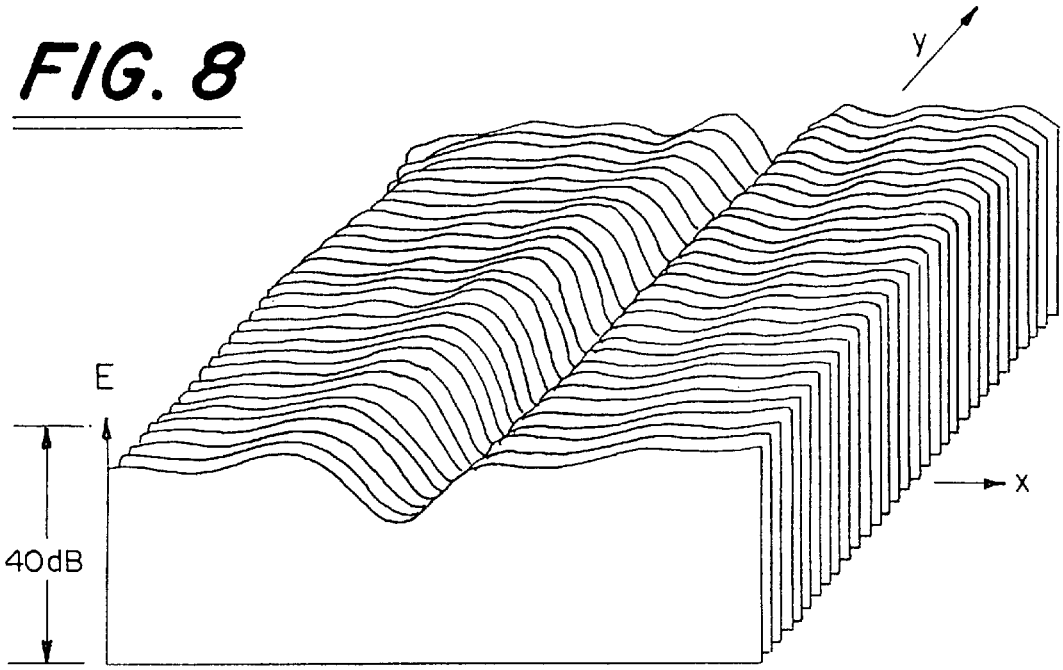
FIG. 8 is a plot of an error measure of an analysis of a prior art loudspeaker array comprising full-range loudspeakers at ±20°, relative to a listener, plotted versus listener displacement left and right, and forward and backward, of an optimum seating position.
Figure 9:
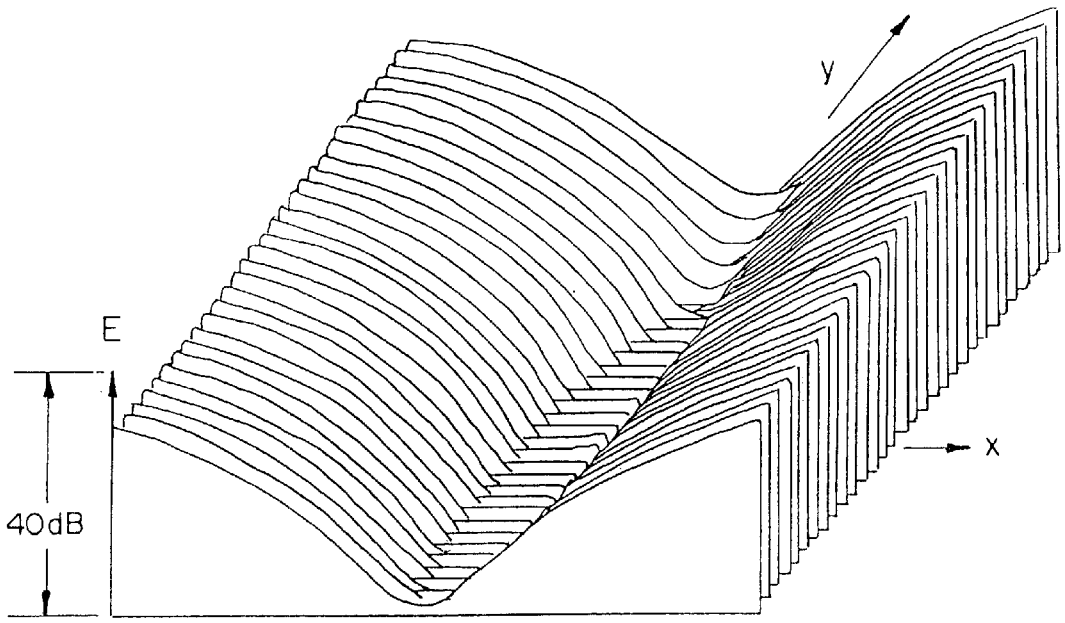
FIG. 9 is a plot of an error measure of an analysis of a prior art loudspeaker array comprising full-range (loudspeakers at ±30, relative to a listener, plotted versus listener displacement left and right, and forward and backward, of an optimum seating position.
Figure 10:
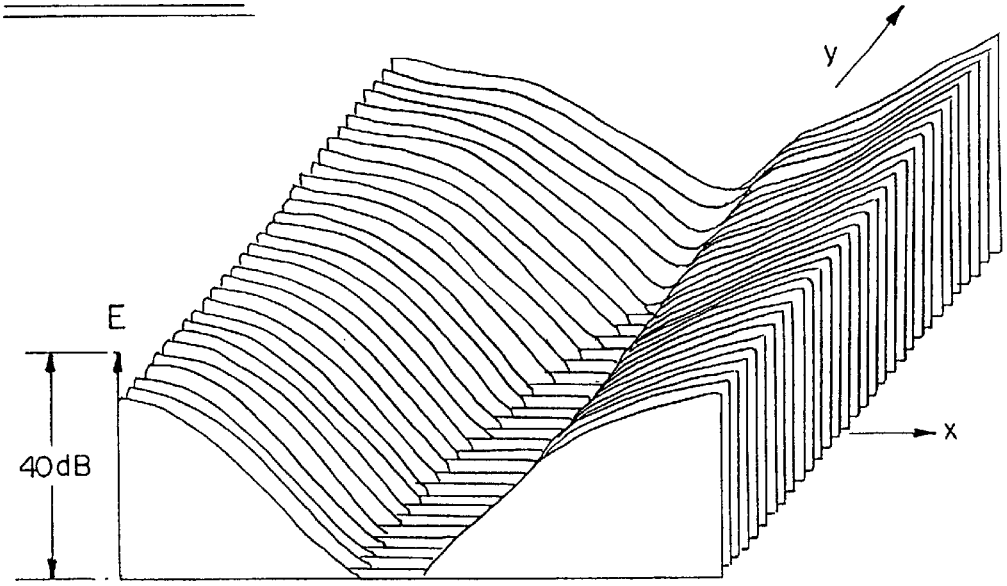
FIG. 10 is a plot of an error measure of an analysis of an embodiment of the invention, a loudspeaker array comprising woofers at ±20° and tweeters at ±3°, both relative to a listener, plotted versus listener displacement left and right, and forward and backward, of an optimum seating position.

In FIG. 8, FIG. 9, and FIG. 10 are shown the error function defined above for the three layouts considered, over the x and y ranges mentioned above. In particular, FIG. 8 shows the error which results from full-range loudspeakers at ±20°, FIG. 9 shows the error from full-range loudspeakers at ±3°, and FIG. 10 shows the error from the modified array 50. All are plotted over the same vertical range of 40 dB, from 7 dB to 47 dB. Despite the lack of a firm connection to a psychoacoustic error metric, these surface plots seem to capture the subjective nature of the sweet spot. By design, all have zero error (−∞dB) at x=0, y=0.

The implications of these figures are clear. The ±20° full-range array has a small sweet spot which is longer in the y-direction than it is wide in the x-direction, a phenomenon readily noticed by listeners of both 3D and more standard stereo systems. The sweet spot for ±3° full-range loudspeakers is much wider by comparison. It is lower than the error plot for ±20° loudspeakers at most points, with the exception at large positive values of y and |x|. The error function for the modified array 50, FIG. 10, closely resembles that of the ±3° array, and in some regions is even slightly lower.

From the results shown from the simulation, it is seen that the modified short-baseline array 50 of the invention, with appropriately designed imaging circuitry, has very nearly the sweet spot size of a very short-baseline prior art array but the signal excursion requirements of a longer-baseline prior art array—it has the best characteristics of both.

The invention also has the advantage of having nearly zero incremental cost to implement, over conventional loudspeaker array-imaging circuit combinations, requiring only a new layout for the various drivers of the loudspeakers and a properly adapted imaging circuit. Neither of these changes comprises a significant recurring manufacturing cost; indeed, some expense may be saved if lower-power amplifiers or less expensive woofers can be used.

Figure 11:
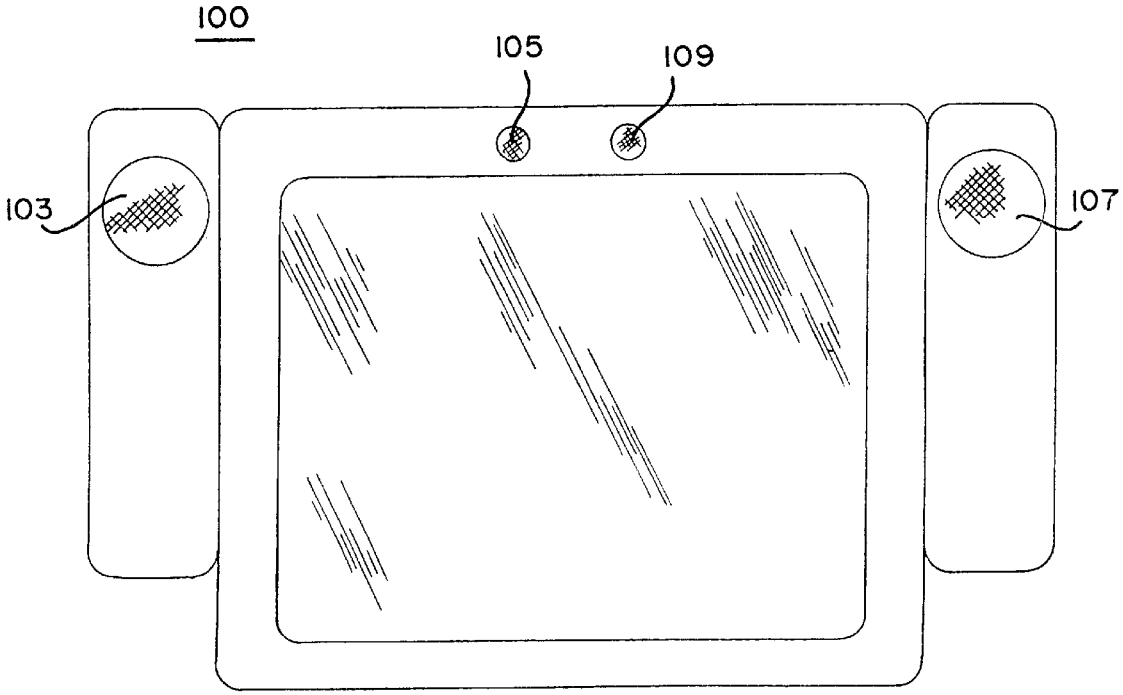
FIG. 11 is a television monitor or computer video monitor, according to the invention.
Figure 12:
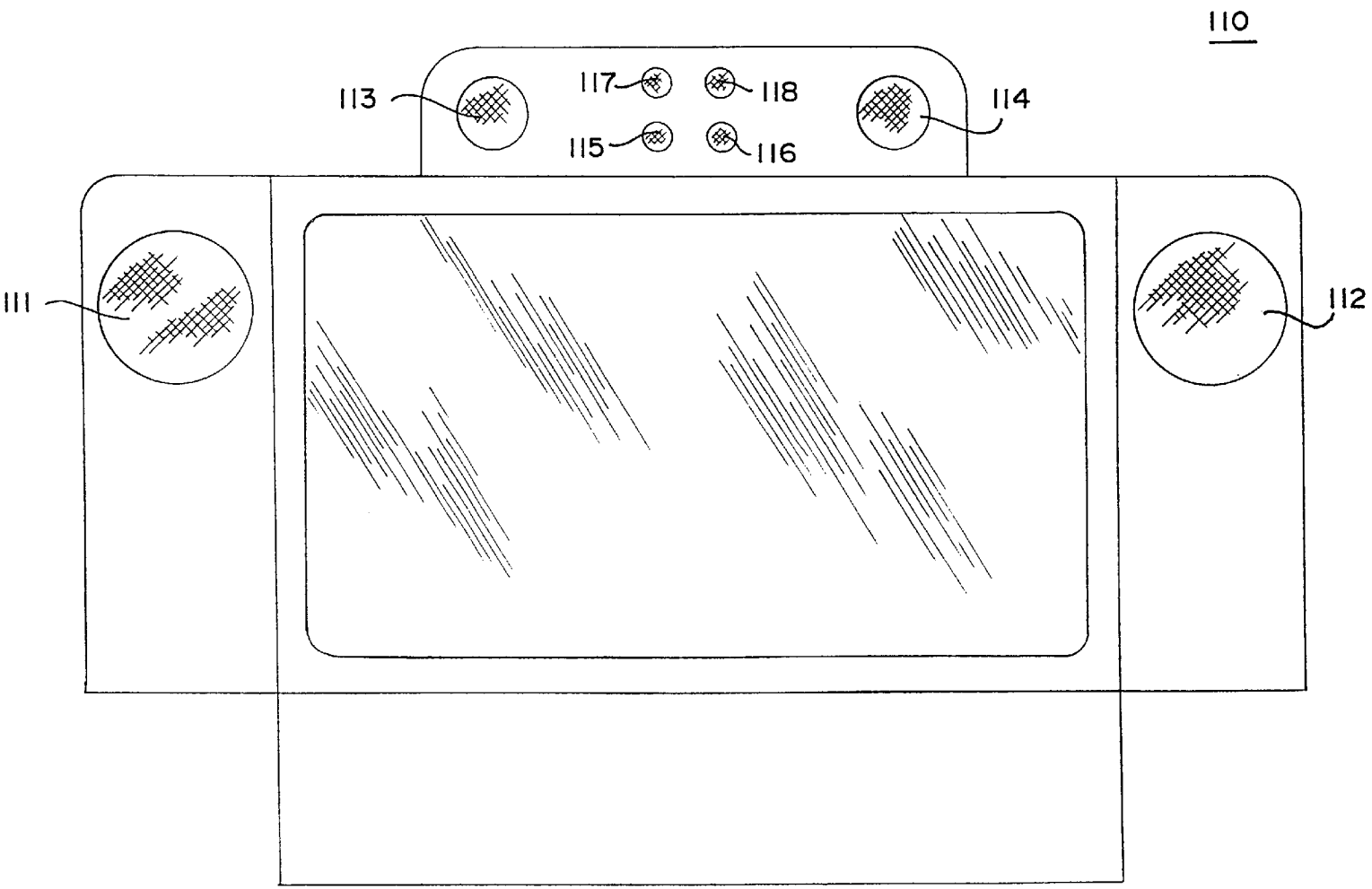
FIG. 12 is a wide-format television receiver console, with a three-way loudspeaker array configured according to the invention for vertical dispersion control from the tweeters.

The applications for which the modified short-baseline array appears to be well-suited include that shown in FIG. 11, a computer or television video monitor which contains the modified array with woofers 103, 107 and tweeters 105, 109 and the associated imaging circuits (not displayed in the figure) such as required for virtual home theaters and game play. FIG. 12 shows a three-way array (woofers 111, 112, midranges 113, 114, and tweeters 115, 116, 117, 118) as part of a television receiver. Also indicated in this figure is a variation on the tweeter configuration to control vertical dispersion in order to reduce reflections, a configuration sometimes used in home theater equipment. Of course, other vertical arraying methods may be used as well. FIGS. 11 and 12 indicate that the placement of the various acoustical emitters may deviate from a straight line as seen by the listener; although not normally an optimal arrangement, since it imposes some path-length variations of its own as the listener adjusts his or her seating height, some amount of such variation is acceptable and may be an acceptable trade-off in light of other design goals such as cabinet design or aesthetics. The reason that some such variation is acceptable is that it is known that path length differences caused by vertical displacement of drivers (as well as vertical) reflections from the floor, ceiling or furniture) have a much smaller effect on horizontal imaging than do horizontal displacements (or reflections) of similar magnitudes.

What has been described is an invention which uses a horizontally diverse array of audio emitters operating over various audio frequency bands, corresponding crossovers and time alignment circuits as needed, and imaging circuits adapted for the particular geometry of the audio emitters and associated crossovers, so that an enlarged sweet spot may be enjoyed by one or more listeners.

While specific embodiments of the audio reproduction system according to the invention have been described for the purpose of illustrating the manner in which the invention may be made and used, it should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. An audio reproduction system for creating an audio presentation with enlarged sweet spot, comprising:

source means for providing an audio program of at least one channel of audio signal;

a first loudspeaker system comprising an audio emitter for a generally higher frequency band of the audio program and an audio emitter for a generally lower frequency band of the audio program;

a second loudspeaker system with an audio emitter for a generally higher frequency band of the audio program and an audio emitter for a generally lower frequency band of the audio program, and wherein the audio emitters of the first and second loudspeaker systems are arranged in a substantially horizontal array, and where the higher-frequency audio emitters of the first and second loudspeaker systems are closer to one another than the lower-frequency audio emitters of the first and second loudspeaker systems;

imaging means for modifying audio spatial characteristics of the emitters of the first and second loudspeaker systems based upon respective transfer functions of the audio emitters; and crossover network means for separating and routing the spatially modified audio program to the various audio emitters of the first and second loudspeaker systems, wherein the imaging means is adapted for the spatial geometry of the first and second loudspeaker systems and the crossover network means associated therewith to create the enlarged sweet spot.

2. The audio reproduction system of claim 1 in which the audio emitters of the first and second loudspeaker systems are displaced generally in front of a listening area and in which the higher-frequency emitter of the first loudspeaker and the higher-frequency emitter of the second loudspeaker lie generally between the lower-frequency emitter of the first loudspeaker and the lower-frequency emitter of the second loudspeaker.

3. The audio reproduction system of claim 2 in which the audio emitters of the first and second loudspeaker systems are configured in a symmetrical fashion with respect to the listening area.

4. The audio reproduction system as in claim 3 wherein the higher and lower frequency emitters of the first and second loudspeakers are located on opposite sides of a centerline of the listening area.

5. The audio reproduction system of claim 1 in which the imaging means creates a virtual source of sound.

6. The audio reproduction system of claim 1 in which the crossover network means allows at least one of the higher-frequency emitters and at least one of the lower-frequency emitters to emit audio signals in substantially overlapping bands of frequencies.

7. The audio reproduction system of claim 1 in which the crossover network means includes as a series component for at least one of the audio emitters of the first and second loudspeaker systems a time delay device to time-align the audio emitter with at least one of the remaining audio emitters.

8. The audio reproduction system of claim 1 in which the higher-frequency audio emitter of the first loudspeaker system and the higher-frequency audio emitter of the second loudspeaker system are retrofitted to associated audiovisual equipment.

9. The audio reproduction system of claim 1 in which the first loudspeaker system and the second loudspeaker system comprise a common structure.

10. The audio reproduction system as in claim 1 wherein the imaging means further comprises head-related transfer functions.

11. An audio reproduction system for creating an audio presentation with enlarged sweet spot, comprising:

source means for providing an audio program of at least one channel of audio signal;

imaging means further comprising a cross-talk canceller for modifying the spatial characteristics of the audio program;

a first loudspeaker system comprising an audio emitter for a generally higher frequency band of the spatially modified audio program and an audio emitter for a generally lower frequency band of the spatially modified audio program;

a second loudspeaker system with an audio emitter for a generally higher frequency band of the spatially modified audio program and an audio emitter for a generally lower frequency band of the spatially modified audio program, and wherein the audio emitters of the first and second loudspeaker systems are arranged in a substantially horizontal array, and where the higher-frequency audio emitters of the first and second loudspeaker systems are closer to one another than the lower-frequency audio emitters of the first and second loudspeaker systems; and crossover network means for separating and routing the spatially modified audio program to the various audio emitters of the first and second loudspeaker systems, wherein the imaging means is adapted for the spatial geometry of the first and second loudspeaker systems and the crossover network means associated therewith to create the enlarged sweet spot.

12. The audio reproduction system of claim 11 in which the crosstalk canceller is implemented as a part of other imaging components.

13. An audio reproduction system comprising:

source means for providing an audio input signal; a horizontally diverse plurality of audio emitters operating over a plurality of different audio frequency bands into a listening space;

imaging circuit means for creating a desired spatial characteristic of the audio signal based upon respective transfer functions of the audio emitters;

frequency dividing network means to separate and distribute portions of the audio input signal to the plurality of audio emitters;

wherein the imaging means is adapted to compensate for the spatial configuration of the plurality of audio emitters and the frequency dividing network means associated therewith, and wherein a set of high frequency emitters of the plurality of audio emitters is located closer together than a set of low frequency emitters of the plurality of audio emitters to create an enlarged sweet spot.

14. The audio reproduction system of claim 13 in which some of the plurality of audio frequency bands are generally higher in frequency than other of the audio frequency bands.

15. The audio reproduction system of claim 14 in which some of the plurality of audio emitters associated with some of the higher-frequency bands of the plurality of audio frequency bands are displaced substantially closer to a geometric centerline of the listening space than some of the other audio emitters associated with the other of the plurality of audio frequency bands.

16. The audio reproduction system as in claim 15 wherein the same audio emitters associated with the higher frequency bands located on a first side of the geometric centerline are driven with a first channel signal of the audio input signal while other audio emitters on the first side of the geometric center line are driven with a second channel signal of the audio input signal.

17. The audio reproduction system as in claim 13 wherein the imaging circuit means further comprises head-related transfer functions.

18. A method of increasing a relative size of a sweet spot in a sound system receiving an audio program, such method comprising the steps of:

disposing a set of woofers equidistant from and at a first angle from a centerline of a listener on either side of the listener;

disposing a set of tweeters equidistant from and at a second angle from the centerline of the listener, the second angle being less than the first angle; and modifying audio spatial characteristics of the audio program based upon respective transfer functions of the woofers and tweeters resulting in the increased relative size of the sweet spot.

19. The method as in claim 18 further comprising the step of applying an audio signal to the set of woofers and set of tweeters.

20. The method as in claim 18 further comprising the step of quantizing an audio image of a source of the audio signal using the set of woofers and set of tweeters.

21. The method of claim 18 whereby the step of modifying includes a step of crosstalk cancellation.

22. An audio reproduction system comprising:

source means for providing an audio input signal;

a horizontally diverse plurality of audio emitters operating over a plurality of different audio frequency bands into a listening space;

frequency dividing network means to separate and distribute portions of the audio input signal to the plurality of audio emitters;

a crosstalk canceller adapted to compensate for the spatial configuration of the plurality of audio emitters and the frequency dividing network means associated therewith based upon a set of head-related transfer functions for creating a desired spatial characteristic of the audio signal; and a set of high frequency emitters of the plurality of audio emitters is located closer to a centerline of the listening space than a set of low frequency emitters of the plurality of audio emitters to create an enlarged sweet spot.

23. A method of increasing a relative size of a sweet spot in a sound system receiving an audio program, such method comprising the steps of:

disposing a set of woofers equidistant from and at a first angle from a centerline of a listener on either side of the listener;

disposing a set of tweeters equidistant from and at a second angle from the centerline of the listener, the second angle being less than the first angle;

adapting a crosstalk canceller for the geometry of the woofers and tweeters; and applying the adapted crosstalk canceller to the audio program resulting in the increased relative size of the sweet spot.

* * * * *